United States Patent [19]

Page

[11] Patent Number: 4,490,591

[45] Date of Patent: Dec. 25, 1984

[54] ELECTRIC SWITCH WITH CLEANING ACTION

[75] Inventor: Paul F. Page, Newington, Conn.

[73] Assignee: Cooper Industries, Inc., Houston, Tex.

[21] Appl. No.: 448,591

[22] Filed: Dec. 10, 1982

[51] Int. Cl.[3] ..... H01H 5/06; H01H 21/40

[52] U.S. Cl. ..... 200/68.2; 200/241

[58] Field of Search ..... 200/6 R, 6 A, 6 B, 6 BA, 200/6 BB, 6 C, 67 R, 67 A, 67 AA, 67 B, 67 C, 67 D, 67 DA, 67 DB, 67 E, 67 F, 67 G, 67 MS, 67 PK, 68.1, 68.2, 68.3, 241, 275

[56] References Cited

U.S. PATENT DOCUMENTS

| | | | |
|---|---|---|---|
| 2,399,462 | 4/1946 | Bryant | 200/6 B |
| 2,999,918 | 9/1961 | Shafer | 200/275 |
| 3,158,704 | 11/1964 | Sorenson | 200/67 R |
| 3,493,702 | 2/1970 | Ramstetter | 200/67 D |
| 3,617,673 | 11/1971 | Weston | 200/275 |
| 3,629,534 | 12/1971 | Reviel | 200/157 |
| 3,858,021 | 12/1974 | Brandlein | 200/164 |
| 4,070,555 | 1/1978 | Carli | 200/6 B |
| 4,072,834 | 2/1978 | Godfrey | 200/16 C |
| 4,121,071 | 10/1978 | Campbell et al. | 200/67 G |

*Primary Examiner*—A. D. Pellinen
*Assistant Examiner*—Morris Ginsburg
*Attorney, Agent, or Firm*—Wigman & Cohen

[57] ABSTRACT

A rocker type electric switch includes a first centrally mounted electrical terminal positioned so that an elongate bridging contact may pivot thereabout to and fro to engage and disengage a second fixed terminal to selectively make electrical contact therewith. The second fixed terminal has separate make, hold and break surfaces. The bridging contact is adapted to snap into initial electrical contact with the make surface of the second fixed terminal, thereafter slide up into abutting relationship with the hold surface of the second fixed terminal, wiping the initial make and hold surfaces clean of any electric arc contamination thereon. In the break cycle, the bridging contact initially slides away from the butt connection of the second fixed terminal, while retaining electrical contact with the terminal. The contact surface of the bridging contact slides away from the hold surface of the second fixed terminal and along a separate break surface thereof until the force moment caused by the plunger member reduces sufficiently to effect a slow break between the bridging contact and fixed terminal. Electric arc generated during the break causes the deposition of contamination upon these separate break surfaces of the bridging contact and second fixed terminal, which surfaces are remote from the make and hold surfaces of the components. In this manner, electric arc contamination is not deposited on the initial make and hold surfaces during the break cycle of the switch.

9 Claims, 6 Drawing Figures

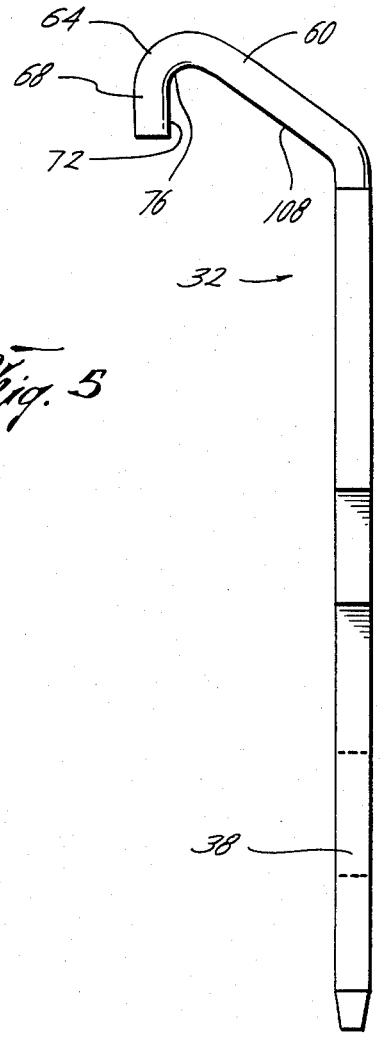
Fig. 5
Fig. 6
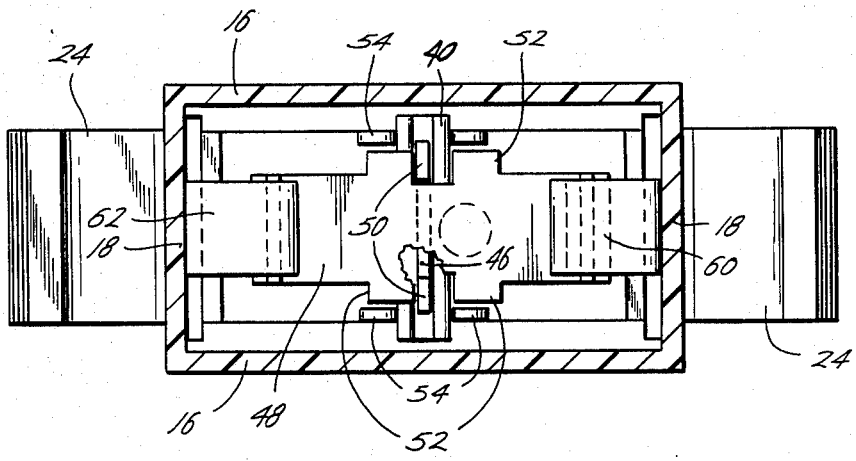

ELECTRIC SWITCH WITH CLEANING ACTION

BACKGROUND OF THE INVENTION

1. Field of the Invention.

The present invention relates generally to electric switches having two or more stationary terminals and a movable bridging contact, and more specifically to an electric switch of this type having a bridging contact that makes with a surface different from the break surface of the fixed terminals in order to avoid the problem of build-up of contamination on the make surface thereof.

2. Description of the Prior Art.

Rocker type switches in which an elongate bridging contact is positioned to be supported by a central fixed terminal so that an end of the bridging contact can be shifted into engagement with an end of a second fixed terminal are well known in the art. These switches commonly have a rocker type switching mechanism, having a spring loaded insulating plunger therein which slides along the elongate bridging contact across the central fixed terminal forming a fulcrum, so that the spring loaded plunger causes the elongate bridging contact to rock about the central fixed terminal into and out of engagement with the second fixed terminal. In this regard, the electrical connection between the movable contact and the second fixed terminal is a simple butt connection. In this type of butt connection, the terminal break surface is also the terminal make surface. The problem with this construction is that when the electrical connection is broken, an electric arc is generated between the two breaking contact elements, thereby depositing electrical contamination on each of these contact surfaces. After repeated breaks of the electrical contacts, this contamination has built up to such a degree that further positive make and break actions are made across these areas of contamination, rather than the initially smooth terminal areas, thereby resulting in extremely highly concentrated areas of current transfer across the build-up of contamination, further compounding the problem and contributing to the build-up of additional arcing contamination. This problem is, of course, greatly accelerated when the switch is used in high current applications.

SUMMARY OF THE INVENTION

According to the invention, an electric switch contains a central fixed terminal, and at least one other fixed terminal mounted within the housing. An essentially elongate bridging contact pivots about a fulcrum surface of the central fixed terminal in a manner to selectively engage and disengage the second fixed terminal to control the electrical connection through the switch. The second fixed terminal includes a hook end, defining separate make, hold and break surfaces. The elongate bridging contact is adapted to engage initially the make surface of the second fixed contact, thereafter slide into abutting engagement with the hold surface of the second fixed terminal, thereby wiping any arc contamination therefrom.

During the break cycle, the bridging contact simultaneously slides along the second fixed terminal to the break surface thereof and pivots about the central fixed terminal to effect the electrical connection break. The break surface is remote from the make and hold surfaces, thereby causing the electrical arc contamination buildup at a location where it will not interfere with the clean make and hold surfaces of the instant switch electrical contacts.

The over-center switching mechanism of the instant invention further provides for the rocker mechanism plunger member being loosely fitted within the receiving bore, in order that the compression spring therein may cause the plunger member to snap from one cocked position within the bore to the opposite cocked position to effect a snap action of the bridging contact during its make cycle.

BRIEF DESCRIPTION OF THE DRAWINGS

For a detailed description of the preferred embodiment of the invention, reference is made to the accompanying drawings, in which:

FIG. 5 is a view of the right side fixed terminal of the electric switch of the present invention showing the separate make, hold and break surfaces thereof; and FIG. 6 is a horizontal sectional view of the electric switch of the present invention, taken along lines 6—6 of FIG. 1, showing the plan relationship of the components of the electric switch of the present invention.

DETAILED DESCRIPTION OF THE INVENTION

Figure 1:
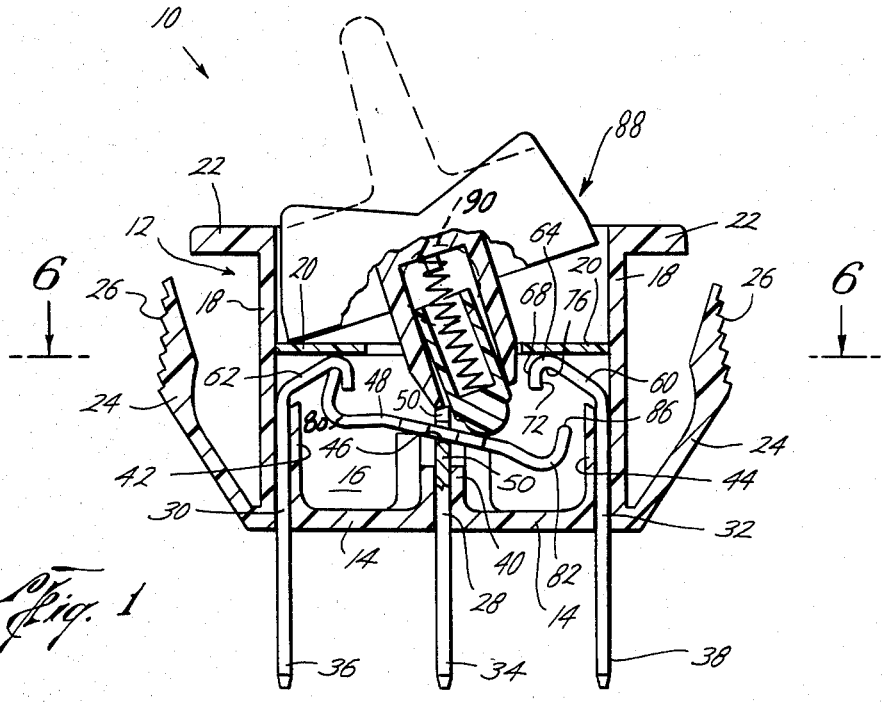
FIG. 1 is a side vertical sectional view of the electric switch of the present invention, showing the bridging contact and the right side fixed terminal in stable open position.

Turning now to the drawings, and more specifically to FIG. 1, the electrical switch of the present invention is shown in vertical section, generally illustrated by the numeral 10. The components of the electric switch 10 are enclosed within a housing 12 in a manner customarily known by those skilled in the art. The housing 12 comprises a base 14, side walls 16 (see also FIG. 6) and end walls 18, forming an open-topped, box-like enclosure. Also included is an internal insulator 20 which insulates the internal electrical contact components from the remaining part of the switch and isolates the electric contact components from the environment.

The housing 12 also includes panel mounting flanges 22 formed with the end walls 18 for mounting the electric switch 10 essentially flush in a panel board or the like. At the end of each end wall 18 opposite that of the panel mounting flanges 22 are formed resilient retaining wings 24, each having a set of teeth 26 formed therewith for gripping onto the back surface of a mounting panel into which the switch 10 is mounted for operation.

As shown in the drawings, in the orientation shown, on the base 14 of the housing 12 are positioned first, second and third fixed metallic electrical terminals 28, 30, 32, respectively. Each of these terminals includes respective terminal wire connecting portions 34, 36, 38 for typical solder or quick connect/disconnect type connections. The first or central terminal 28 is shown positioned in the center portion of the base 14 and is press-fitted into the molded housing. Structural bosses 40 formed with the base 14 support the central terminal 28 in a manner to retain the terminal in a rigidly secure upright position as shown. Likewise second and third structural bosses 42, 44 are formed with the housing base 14 to support respective terminals 30, 32 in a customary manner to assure the structural integrity of the switch housing and to provide electrical clearances for the terminals.

Again referring to any of FIGS. 1–4, the central electrical terminal 28 includes a center section 46 across the top portion thereof defining a fulcrum pivot for supporting a bridging contact 48 and providing electrical connection therebetween. The center section 46 is slightly convex shaped and is oriented generally parallel to the second and third terminal hook inner radii 76, 78. In this manner, the bridging contact 48 automatically aligns itself for optimum electrical contact with respective hook end make flat surfaces 72, 74 and inner radii 76, 78. The fulcrum pivot section 46 terminates at each end thereof in a tab or raised section 50 (See FIG. 6) for retaining the bridging contact 48 in proper alignment therewith. As is best shown in FIG. 6, the bridging contact 48 includes laterally extending tabs 52 that cooperate with the central terminal fulcrum section tabs 50 to retain this alignment. These bridging contact tabs 52 also cooperate with abutting bosses 54 formed in the housing side walls 16 to ensure this bridging contact alignment. As will be explained in greater detail hereinbelow, the longitudinal spacing between these laterally extending tabs 52, and specifically their relationship to the "L" end rounded edge 86, determine the location at which the "L" end rounded edge makes initial electrical contact with the terminal hook end make flat surface 72.

Referring again to any of FIGS. 1–4, the electric switch of the present invention also includes second and third metallic electrical terminals 30, 32 respectively, staked or press-fitted into the housing base in a manner commonly known to those skilled in the art. As shown, the second and third terminals are identical in structure, and therefore identical in operation. Therefore, for purposes of explanation of the invention herein, only the right side electrical terminal 32 will be discussed, it being understood that such discussion and explanation will likewise apply to the corresponding left side terminal 30.

The third terminal 32 is retained within the housing 12 in the customary manner. The upper end of the third terminal 32 is formed into a flat angled portion 60, terminating in a hook section 64. The hook section 64 further includes a short straight end portion 68, having an end flat surface 72, formed as an extension of an inner radius 76 of the hook section 64. As will be explained in greater detail hereinbelow, these flat and inner radius surfaces 72 and 76 define fixed terminal contact make and hold surfaces which cooperate with the bridging contact 48 to establish electrical connection therebetween.

As shown in the drawings, the bridging contact 48 is basically elongate in shape, having turned up "L" shaped ends 80, 82 for establishing electrical contact with the second and third terminals 30 and 32. These ends 80, 82 include respective rounded edges 84, 86 for electrically engaging respective hook end inner radii 76, 78, as shown.

As shown in FIG. 6, the bridging contact lateral tabs 52 are spaced apart a distance considerably more than the thickness of the central terminal 28. This permits the bridging contact 48 to shift to and fro in an axial direction while functionally positioned in the notch defined by the central terminal fulcrum pivot section 46 and the pivot section tabs 50 in a manner to make initial electrical contact with respective hook end flat surfaces 72, 74, thereafter to shift into stable electrical contact with respective terminal hook inner radii 76, 78, as will be explained in greater detail hereinbelow in the discussion of the operation of the electrical switch.

Turning once again to the drawings, a manually operated rocker device 88 is positioned within the cavity defined by the electric switch housing 12 on the side of the partition 20 opposite that of the electrical terminals and bridging contact member (i.e. above the partition 20, as shown in the drawings). This rocker device 88 is retained within the switch housing 12 in a well known manner, typically by a pair of aligned trunnions 90 formed on each side thereof for pivotal engagement within housing pivot holes (not shown). The rocker device 88 includes a main body portion 92, including a flat bottom surface 94, defining stops for the pivotal movement thereof in the customary manner. Extending from the main body portion 92, normal to the flat surface 94 is a lower projecting portion 96 having an internal bore 98 therein as shown. The lower projecting portion 96 carries within it a plunger member 100, which is spring loaded at 102 to constantly be urged outwardly therefrom to engage the bridging contact 48, as shown. The lower end of the plunger member 100 has a rounded end 110, defining a semi-circular cross section in order that the plunger may easily slide along the upper surface of the bridging contact 48 as the rocker device 88 is shifted between its two operating positions.

In accordance with the instant invention, the plunger member 100 is loosely fitted within the internal bore 98 in order that it may freely shift slightly from side to side within the bore during the operation of the switch 10, as will be explained in greater detail hereinbelow.

In the preferred embodiment of the second and third terminals utilized in the switch of the present invention, the terminal contact hold surface is defined by the terminal hook inner radius 76. This inner radius 76 transforms into a flat break surface 108 of the hook end, defined by the under surface of the third terminal flat angled portion 60. This flat break surface 108 functions in the manner described hereinbelow to prevent the accumulation of electrical contamination and build-up on the make and hold mating surfaces of the bridging contact "L" shaped ends and fixed terminal hook end surfaces.

OPERATION

The switch depicted in the drawings is a single pole, double throw rocker type. For purposes of explaining the operation, only the third electrical terminal 32 and the corresponding half of the bridging contact 48 (the right half of the switch as shown in the drawings) will be discussed, with the understanding that the switching mechanism of the electrical switch of the present invention operates in exactly the same mode in the left half of the switch, as well as with any number of poles in a multiple pole switch.

The position shown in FIG. 1 is the stable "OFF" position of the right side of the switch. In this position, the rocker device rests in its counterclockwisemost position, with the plunger spring urging the plunger member downwardly against the top surface of the elongate bridging contact, to hold the bridging contact in its "open" position. Note that in this position, the plunger member is also cocked in its counterclockwisemost position, its outer walls engaging the internal bore of the rocker device lower projecting portion only at two diagonally opposite points: the upper left edge of the plunger member and the lower right surface of the internal bore. Note also that in this position, the bridging contact is shifted to the left of a symmetric alignment with the central electric terminal longitudinal axis. This is due to the position of the left side electrical terminal hook inner radius in relation to the distance from the left "L" end rounded edge and the space defined by the bridging contact laterally extending tabs.

Figure 2:
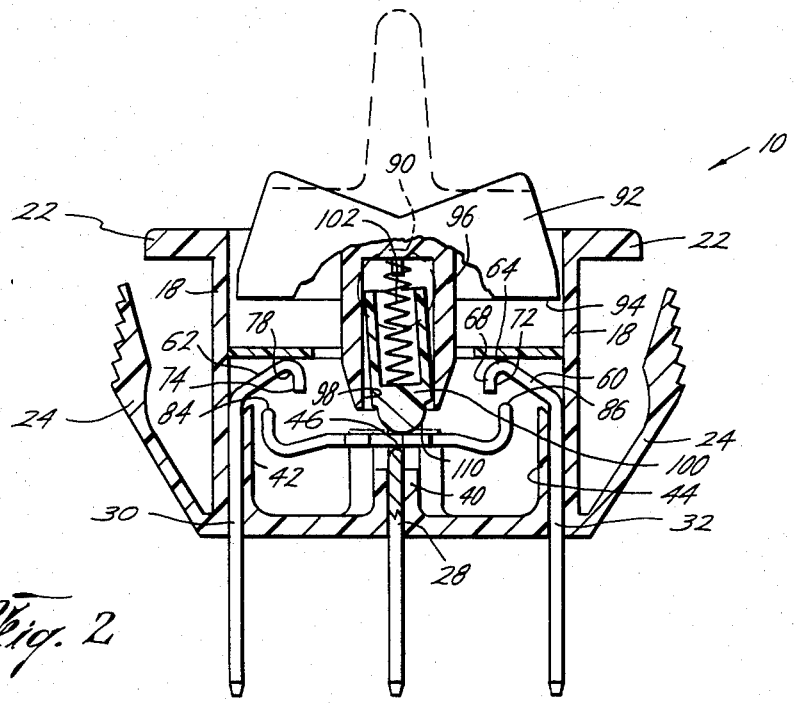
FIG. 2 is a view similar to FIG. 1, showing the relative position of the switch components in the first step of the sequence of operation of the switch.

As the rocker device is rotated clockwise to the position shown in FIG. 2, the point of contact of the plunger member upon the bridging contact moves along the top surface of the bridging contact leftwardly to a position slightly to the right of the longitudinal center axis of the central electrical terminal, when the rocker device is in a dead center position with respect to the housing 12. The reason for this is that, as shown in FIG. 2, the plunger member is still cocked in its counterclockwisemost position, as in FIG. 1, the only difference being that the plunger member has been moved up into the internal bore, compressing the spring slightly. The plunger member remains in contact with the elongate bridging contact at a point slightly to the right of the fulcrum surface center line. In this over-center position, there is yet no contact between the right side bridging contact "L" end and the right side fixed terminal. Those skilled in the art will readily appreciate that the slight friction between the plunger member and the upper surface of the bridging terminal as the plunger member moves to the left upwardly along the contact, causes the bridging contact to shift to its leftmost position, as determined by the spacing between the bridging contact laterally extending tabs, as is best shown in FIG. 2. Additionally, it will be readily appreciated that in single pole, single throw switches of this type, the same frictional force causes the leftward movement of the bridging contact with respect to the central fixed terminal, regardless of the original open position of the bridging contact (see FIG. 1).

Figure 3:
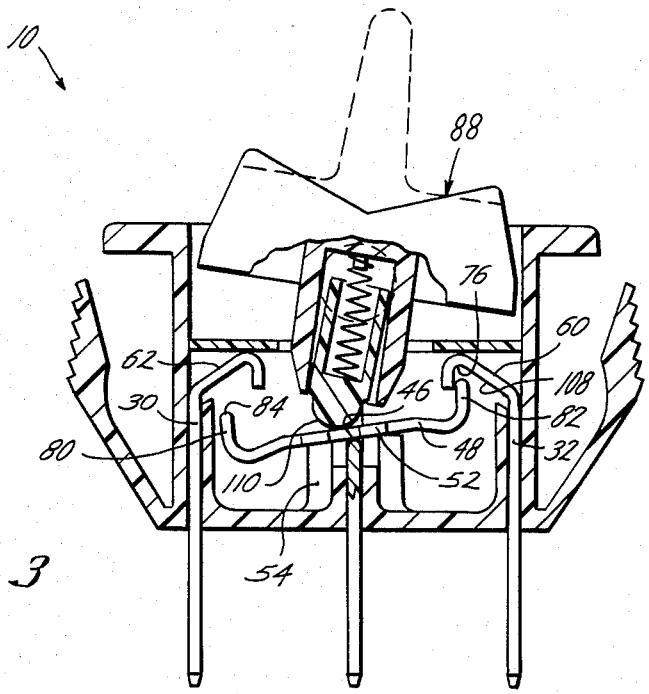
FIG. 3 is a view to similar to FIGS. 1 and 2, showing the relative position of the switch components in the second step of operation, wherein the bridging contact makes initial electrical contact with the right side fixed terminal.

FIG. 3 shows the relative position of the components of the electric switch in the next sequence of steps. As the plunger member crosses the center line of the central terminal longitudinal axis, the plunger snaps to the left (to the clockwisemost position within the rocker device internal bore), to cause the bridging contact to rapidly shift up into engagement with the flat surface 72 of the third fixed terminal hooked end, as shown in FIG. 3. Those skilled in the art will readily appreciate that the excessive play between the plunger member and the rocker device internal bore prevents any "teasing" effect, common in over-center type switching mechanisms, by forcing the plunger to snap between the two opposite cocked positions within the bore.

Since this position of the rocker device shown in FIG. 3 is unstable due to the force of the plunger spring 102, the rocker device continues to shift clockwise, due to the expansion of the plunger spring, into its clockwisemost resting position. As this is happening, the plunger spring is forcing the plunger member out of the internal bore so that the semicircular end section thereof slides along the upper surface of the bridging contact toward the left, constantly applying the friction force to retain the bridging contact in its leftmost position, as shown.

Figure 4:
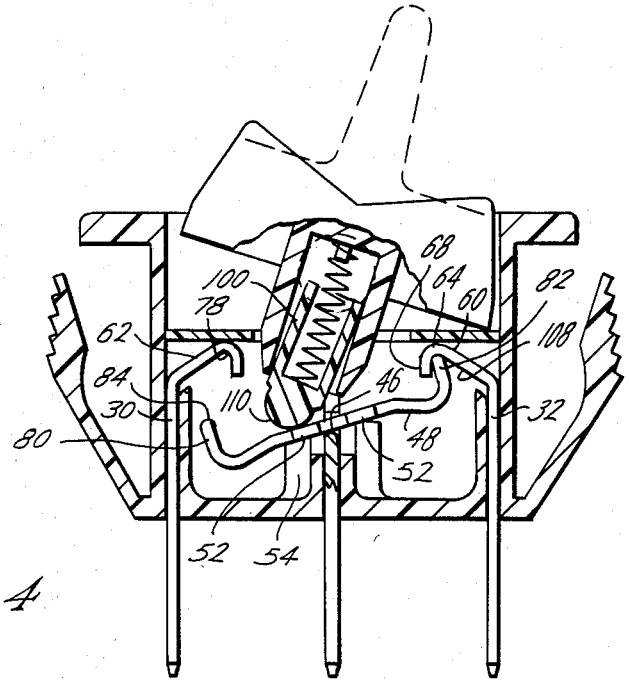
FIG. 4 is a view similar to FIGS. 1–3, showing the relative position of the switch components of the electric switch of the present invention when the contacts are in the stable hold, or current carrying, position.

As the plunger member slides to the left of the central fixed terminal, the moment caused by the spring force about the central fixed terminal fulcrum pivot surface increases until it surpasses the opposing moment of the right side fixed terminal hook end section against the bridging contact right side "L" shaped end. When this happens, this increased moment causes the bridging contact "L" shaped end to slide up into engagement with the fixed terminal hook end inner radius, defining the "hold" segment of the fixed terminal, as shown in FIG. 4. As the "L" shaped end slides up the hook end initial make surface, it imparts a wiping action thereto to continuously wipe the mating make surfaces clean of any arc contamination caused by the make. Additionally, because the contact with the hook section hold segment is made by the "L" end sliding thereinto as opposed to a direct head-on butt-type connection, no bounce is introduced during this make step. The initial sliding and wiping action serves to dampen any tendency of the making components to bounce during make.

Of course, as this "L" shaped end slides up the straight surface of the fixed terminal hook portion, the bridging contact shifts slightly to the right, against the continuous force of the plunger member and plunger spring urging the bridging contact to the left. In this position, as shown in FIG. 4, complete electrical contact is made between the bridging contact and the right side hook shaped fixed terminal across the entire mating surfaces of the "L" end rounded edges and the hook end inner radius. This is the stable "ON" position of the right side of the switch.

Referring again to FIG. 4, as the rocker device is pivoted counterclockwise from the position shown in order to break the electrical connection between the bridging contact and the right side fixed terminal, the same sequence of steps occurs as described hereinabove with relation to FIG. 1. In this regard, it will be apparent that as the rocker device is pivoted counterclockwise and the plunger member slides rightwardly along the upper surface of the bridging contact, frictional force causes the bridging contact to slide slightly to the right and against the terminal break surface 108. Further rightward movement of the plunger member along the upper surface of the bridging contact reduces the force moment holding the "L" shaped rounded edge against the terminal contact surface, resulting in a "slow break" of the bridging contact from the flat break surface 108. Still further leftward movement of the plunger member along the bridging contact shifts the bridging contact to the left, as permitted by the spacing between the laterally extending tabs, to a position which is a mirror image of FIG. 2. Those skilled in the art will realize that, from this point, the sequence of steps outlined hereinabove is repeated, in reverse direction of operation, to shift the bridging contact into electrical connection with the left side fixed terminal, as shown in FIG. 1.

Those skilled in the art will readily appreciate the attributes of the electrical switch of the present invention. Specifically, each of the terminals has separate make, hold and break surfaces so that electric contamination due to the arc produced at the break is deposited on the break surface, and not on the make or hold terminal surfaces. Secondly, the initial make surface of the hook end fixed terminal is a flat surface. Once electrical contact is made, the bridging contact "L" end rounded edge slides along this flat make surface, thereby wiping and cleaning away any arcing contamination that has occurred during the make. Thirdly, the hold surface is across a substantial portion of the rounded edge of the "L" end of the bridging contact as it mates with the inner radius of the hook end of the fixed terminal, for optimum current transfer therebetween.

Fourthly, the shift of the plunger member within the rocker device internal bore ensures positive and rapid make shifting movements of the bridging contact. This also contributes to the maintenance of clean make and hold surfaces and to the reduction in arc contamination build-up on the bridging contact.

Although particular embodiments of the invention have been illustrated in the accompanying drawings and description in the foregoing Detailed Description of the Invention, it will be understood that the invention is not limited to the embodiments disclosed, but is intended to embrace any alternatives, modifications, rearrangements and/or substitutions of elements as fall within the scope of the invention.

What is claimed is:

1. An electric switch, comprising:

(a) a housing;

(b) a first fixed terminal defining a single-point fulcrum pivot surface mounted in said housing;

(c) a second fixed terminal having separate contact make, hold and break surfaces mounted in said housing;

(d) a bridging contact mcmber having an essentially flat midsection adapted to be pivotally supported by said first fixed terminal fulcrum pivot surface, said bridging contact member being selectively moveable into and out of engagement with said second fixed terminal;

(e) shifting means for shifting said bridging contact member from initial engagement with said second fixed terminal make surface into engagement wiht said second fixed terminal hold surface; and (f) over-center switch operating means moveable between two positions for selectively shifting said bridging contact member into engagement and out of engagement with said second fixed terminal.

2. An electrical switch as set forth in claim 1, wherein said bridging contact member comprises an essentially flat body section having a slot therein for receiving an extended portion of said first fixed terminal for permitting said bridging contact member to slide in an axial direction upon said essentially flat body section.

3. An electric switch as set forth in claim 2, wherein said shifting means further comprises a plunger member carried by said over-center switch operating means for engaging said bridging contact member for urging said bridging contact member to shift from initial engagement with said second fixed terminal make surface into engagement with said second fixed terminal hold surface.

4. An electric switch as set forth in claim 1, wherein said second fixed terminal hold surface is defined by the inner radius of a hook section of said second fixed terminal.

5. An electric switch as set forth in claim 4, wherein said fixed terminal make surface is defined by a first straight section adjacent said second fixed terminal hold surface.

6. An electrical switch as set forth in claim 5, wherein said second fixed terminal break surface is defined by a second straight section adjacent said fixed terminal hold surface, opposite said fixed terminal make surface.

7. An electrical switch as set forth in claim 3, wherein said plunger means is adapted to shift within said over-center switch operating means to provide a snap effect to selectively urge said bridging contact member to rapidly shift into engagement with said second fixed terminal make surface.

8. An electrical switch comprising:

(a) a housing;

(b) a first fixed terminal mounted in said housing, said terminal defining a single-point fulcrum pivot surface and having a positioning tab extending from and normal to said fulcrum pivot surface;

(c) a second fixed terminal mounted in said housing, said terminal including (1) a curved section, the inner radius thereof defining a hold contact surface;

(2) a first straight section adjacent said hold contact surface defining a make contact surface; and (3) a second straight section adjacent said hold contact surface opposite said first straight section defining a break contact surface;

(d) a bridging contact member having an essentially flat midsection, adapted to be pivotally supported by said first fixed terminal fulcrum pivot surface, said bridging contact member including a curved section having a round end for selectively engaging said make contact surface and said hold contact surface of said second fixed terminal; and (e) a rocker type over-center switching mechanism pivotally carried by said housing and movable between two positions for causing engagement and disengagement of said bridging contact member with said second fixed terminal.

9. An electric switch as set forth in claim 8, further comprising a spring pressed plunger member carried by said switching mechanism in a manner to snap between first and second positions for rapidly shifting said bridging contact member into engagement with said second fixed terminal.

* * * * *

UNITED STATES PATENT AND TRADEMARK OFFICE

CERTIFICATE OF CORRECTION

PATENT NO. : 4,490,591

DATED : December 25, 1984

INVENTOR(S) : Paul F. Page

It is certified that error appears in the above—identified patent and that said Letters Patent is hereby corrected as shown below:

IN THE CLAIMS:

Claim 1, paragraph (e), line 41, change "wiht" to --with--.

Claim 7, line 18, change "means" to --member--.

Signed and Sealed this

*Fourteenth* Day of *May 1985*

[SEAL]

*Attest:*

DONALD J. QUIGG

*Attesting Officer* *Acting Commissioner of Patents and Trademarks*